US009837761B1

(12) United States Patent
Hardy et al.

(10) Patent No.: US 9,837,761 B1
(45) Date of Patent: Dec. 5, 2017

(54) ELECTRICAL CABLE CONNECTOR WITH ROTATABLE HOUSING

(71) Applicant: TYCO ELECTRONICS CORPORATION, Berwyn, PA (US)

(72) Inventors: Douglas John Hardy, Middletown, PA (US); John Wesley Hall, Harrisburg, PA (US); John Mark Myer, Millersville, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/272,596

(22) Filed: Sep. 22, 2016

(51) Int. Cl.
*H01R 13/627* (2006.01)
*H01R 24/40* (2011.01)
*H01R 103/00* (2006.01)

(52) U.S. Cl.
CPC ..... *H01R 13/6272* (2013.01); *H01R 24/40* (2013.01); *H01R 2103/00* (2013.01)

(58) Field of Classification Search
CPC .... H01R 13/6272; H01R 9/053; H01R 24/40; H01R 2103/00
USPC ..... 439/357
See application file for complete search history.

(56) References Cited

U.S. PATENT DOCUMENTS 6,840,822 B1 1/2005 Hall et al.
7,160,152 B2 1/2007 Tsai
7,347,742 B2 3/2008 Hall et al.
7,980,894 B1 * 7/2011 Hall ..... H01R 9/053 439/585

* cited by examiner

*Primary Examiner* — Jean F Duverne

(57) ABSTRACT

An electrical cable connector includes a contact subassembly and a housing. The contact subassembly is terminated to an electrical cable. The contact subassembly includes a center contact, a dielectric holder, and an outer contact. The contact subassembly has a protrusion extending outward from an outer surface of the contact subassembly. The housing defines a cavity that receives the contact subassembly therein. The electrical cable extends from the housing through an opening at a rear end of the housing. The housing includes a retention mechanism that engages the protrusion of the contact subassembly to secure an axial position of the contact subassembly in the cavity relative to the housing. The retention mechanism allows the housing to rotate relative to the contact subassembly and the cable.

20 Claims, 8 Drawing Sheets

ELECTRICAL CABLE CONNECTOR WITH ROTATABLE HOUSING

BACKGROUND OF THE INVENTION

The subject matter herein relates generally to electrical connectors that mount to electrical cables.

Electrical connectors have been used to interconnect coaxial cables. Coaxial cables are used in various radio frequency (RF) applications. In the automotive industry, for example, there is a demand for coaxial cables and connectors due in part to increased electrical devices within automobiles, such as AM/FM radios, cellular phones, GPS, satellite radios, wireless communication systems, and the like.

The housings of some known electrical cable connectors are configured to be key-mated to an appropriate mating connector in a specific angular orientation. Key-mating the connectors reduces the occurrence of accidentally connecting two inapposite cable connectors, which could damage both the connectors and the electrical devices conductively linked to the connectors by the coaxial cables. However, if the housings of the connectors are not able to rotate relative to the cables, aligning the housings in the specified angular orientation during a mating operation may apply torsional stress and tension on the cable and the components of the connectors terminated to the cable. Such torsional forces may damage the performance of the electrical connectors, such as by pulling one or more wires of the cable out of engagement with a center contact of the corresponding connector. A need remains for allowing the housing to rotate relative to the cable while avoiding extra manufacturing and assembly costs attributable to the addition of auxiliary components, such as secondary locks.

BRIEF DESCRIPTION OF THE INVENTION

In one embodiment, an electrical cable connector is provided that includes a contact subassembly and a housing. The contact subassembly is terminated to an electrical cable. The contact subassembly includes a center contact, a dielectric holder, and an outer contact. The contact subassembly has a protrusion extending outward from an outer surface of the contact subassembly. The housing extends between a front end and a rear end. The housing defines a cavity that receives the contact subassembly therein. The electrical cable extends from the housing through an opening at the rear end. The housing includes a retention mechanism that engages the protrusion of the contact subassembly to secure an axial position of the contact subassembly in the cavity relative to the housing. The retention mechanism allows the housing to rotate relative to the contact subassembly and the cable.

In another embodiment, an electrical cable connector is provided that includes a contact subassembly and a housing. The contact subassembly is terminated to an electrical cable. The contact subassembly includes a center contact, a dielectric holder, and an outer contact. The contact subassembly has a protrusion extending outward from an outer surface of the contact subassembly. The housing extends between a front end and a rear end. The housing defines a cavity that receives the contact subassembly therein. The electrical cable extends from the housing through an opening at the rear end. The housing includes an annular track along a perimeter of the cavity that receives the protrusion of the contact subassembly therein. The protrusion is configured to move along a circumferential length of the annular track as the housing is rotated relative to the contact subassembly and the electrical cable. The housing includes a retention ledge that defines a rear end of the annular track. The retention ledge engages a catch surface of the protrusion to block rearward axial movement of the contact subassembly relative to the housing.

DETAILED DESCRIPTION OF THE INVENTION

Figure 1:
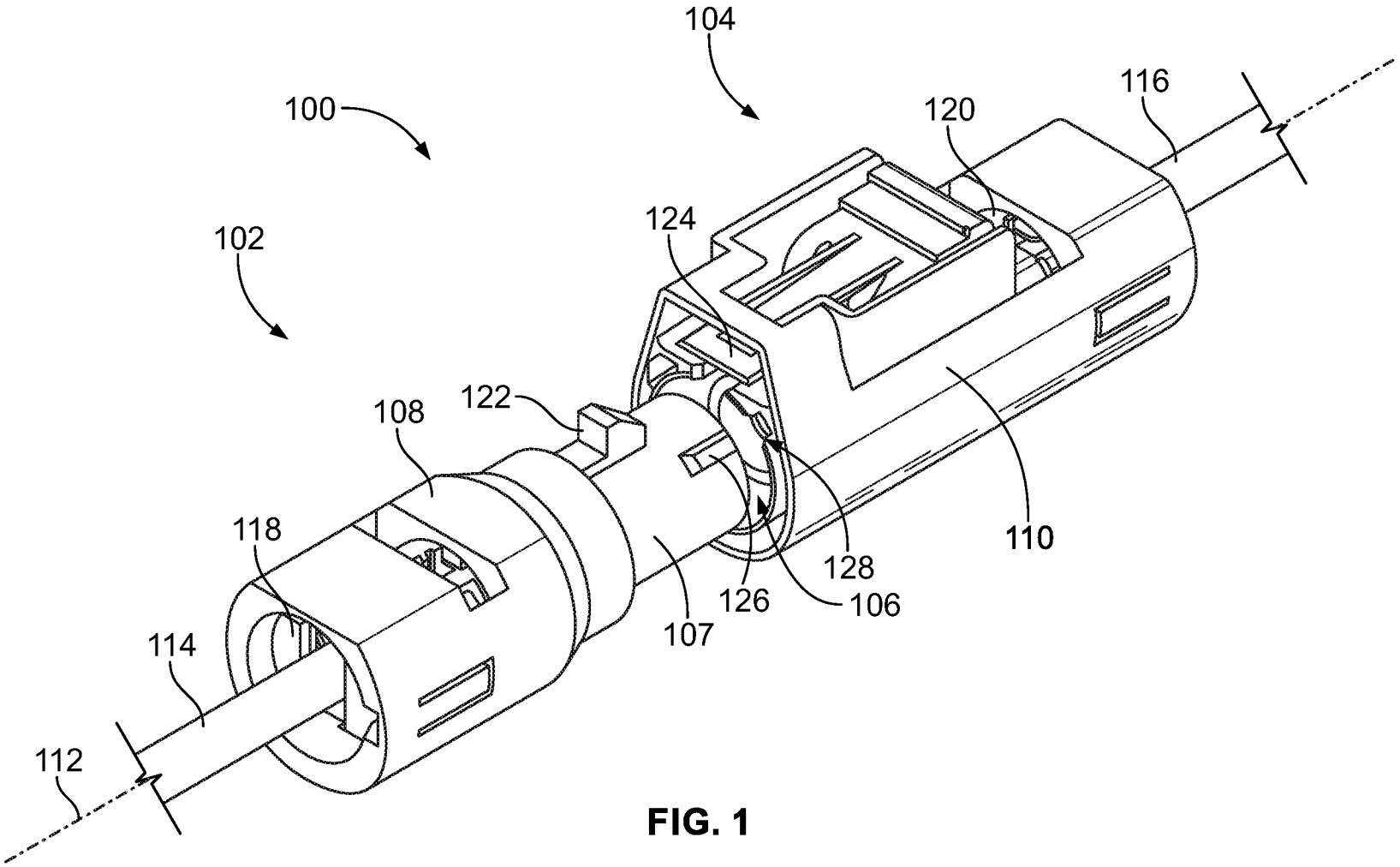
FIG. 1 illustrates a connector system formed in accordance with an exemplary embodiment.

FIG. 1 illustrates a connector system 100 formed in accordance with an exemplary embodiment. The connector system 100 includes a first electrical connector 102 and a second electrical connector 104 that are configured to be mated together to transmit electrical signals (for example, power, control signals, data, and/or the like) therebetween. In the illustrated embodiment, the first electrical connector 102 is a male connector, and the second electrical connector 104 is a female connector, such that a mating end of the first electrical connector 102 is received within a cavity 106 of the second electrical connector 104 during a mating operation. More specifically, a nose cone 107 of a housing 108 of the male connector 102 is received within the cavity 106 defined by a housing 110 of the female connector 104. Although shown as un-mated in FIG. 1, the male and female connectors 102, 104 are poised for mating along a mating axis 112.

The male connector 102 and the female connector 104 are mounted and electrically connected to corresponding electrical cables 114, 116, respectively. In an alternative embodiment, one of the male connector 102 or the female connector 104 may be mounted to a circuit board instead of a cable. The male and female connectors 102, 104 each include a respective contact subassembly 118, 120 located within the respective housing 108, 110. The contact subassembly 118 of the male connector 102 is terminated (for example, directly mechanically and electrically connected) to the cable 114, and the contact subassembly 120 of the female connector 104 is terminated to the cable 116. When the connectors 102, 104 are mated, complementary conductive components of the contact subassemblies 118, 120 engage each other to establish a conductive signal pathway across the connectors 102, 104 to connect the cables 114, 116.

The housings 108, 110 of the connectors 102, 104 include complementary latching features that engage each other when the connectors 102, 104 are fully mated to secure the connectors 102, 104 in the mated position. In the illustrated embodiment, the housing 108 of the male connector 102 includes a catch 122 that is configured to engage a complementary deflectable primary latch 124 on the housing 110 of the female connector 104. The contact subassemblies 118, 120 are securely held inside the corresponding housings 108, 110, such that the interconnection between the catch 122 and latch 124 of the housings 108, 110, respectively, retains an electrical connection between the contact subassemblies 118, 120. The latch 124 is able to be lifted or pivoted over the catch 122 in order to disconnect the male and female connectors 102, 104. In an alternative embodiment, the male connector 102 includes the primary latch and the female connector 104 includes the catch.

In the illustrated embodiment, the male connector 102 and the female connector 104 constitute FAKRA connectors which comply with the standard for a uniform connector system established by the FAKRA automobile expert group. FAKRA is the Automotive Standards Committee in the German Institute for Standardization, representing international standardization interests in the automotive field. The FAKRA connectors have a standardized keying system and locking system that fulfill the high functional and safety requirements of automotive applications by restricting the mate-ability of each of the connectors 102, 104 to one or more specific mating connectors according to the FAKRA standards. For example, the male connector 102 in the illustrated embodiment has one or more keying ribs 126, and the female connector 104 has one or more keyholes 128 that receive the keying ribs 126 when the connectors 102, 104 are mated and properly aligned.

The keying ribs 126 are only received in the keyholes 128 in one specific angular orientation of the male housing 108 relative to the female housing 110. In one or more embodiments described herein, the housings 108, 110 of the connector system 100 are rotatable relative to the corresponding cables 114, 116. Thus, although the male housing 108 only mates to the female housing 110 in a single orientation, rotation of the male housing 108 to align the male housing 108 with the female housing 110 does not impart tension and other torsional forces on the cable 114 that is terminated to the male housing 108. As described herein, the male and female connectors 102, 104 each include retention mechanisms that allow the respective housings 108, 110 to rotate relative to the corresponding cables 114, 116 without requiring auxiliary components inserted into the connectors 102, 104, such as secondary locks or clips.

Figure 2:
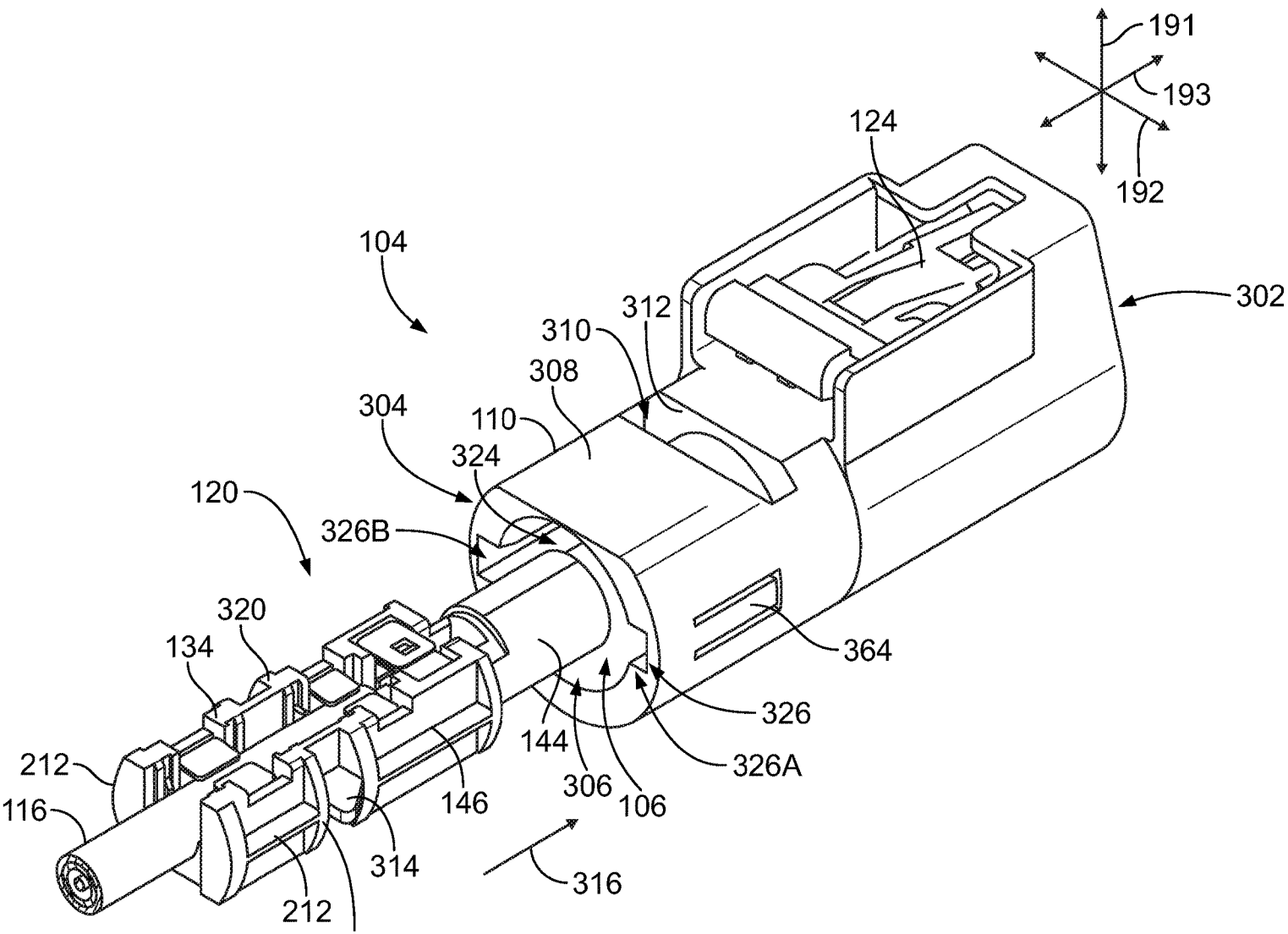
FIG. 2 is an exploded rear perspective view of an electrical connector of the connector system according to an embodiment.

FIG. 2 is an exploded rear perspective view of the female electrical connector 104 according to an embodiment. The contact subassembly 120 is terminated to the cable 116, meaning that the contact subassembly 120 is mechanically and electrically connected to the cable 116. The contact subassembly 120 is disposed outside of the cavity 106 of the housing 110, but is poised for loading into the cavity 106. The exploded connector 104 is oriented with respect to a vertical or elevation axis 191, a lateral axis 192, and a longitudinal axis 193. The axes 191-193 are mutually perpendicular. Although the vertical axis 191 appears to extend generally parallel to gravity, it is understood that the axes 191-193 are not required to have any particular orientation with respect to gravity.

Although FIG. 2 shows the female connector 104, the following description of various embodiments of the female connector 104 may also apply to the male connector 102 (shown in FIG. 1). For example, the housing 108 and contact subassembly 118 of the male connector 102 may have components similar in shape, orientation, and function as the components of the housing 110 and contact subassembly 120 described below.

The housing 110 extends longitudinally between a front end 302 and a rear end 304. As used herein, relative or spatial terms such as "front," "rear," "top," "bottom," "first," and "second" are only used to distinguish the referenced elements and do not necessarily require particular positions or orientations relative to the surrounding environment of the electrical connector 104 and the connector system 100 (shown in FIG. 1). In the illustrated embodiment, the front end 302 is a mating end, such that the keyholes 128 (shown in FIG. 1) are located along, or proximate to, the front end 302. The rear end 304 is a cable end such that the cable 116 protrudes from the housing 110 through an opening 306 at the rear end 304 when the contact subassembly 120 is loaded within the housing 110. The cavity 106 extends through the housing 110 between the front and rear ends 302, 304. In the illustrated embodiment, the housing 110 is an inline housing, but in an alternative embodiment the housing 110 may be a right angle housing. For example, the cable end may not be co-linear with the mating end of the housing 110 in an alternative embodiment.

The housing 110 is generally cylindrical in shape but includes a top side 308 that is at least partially planar. The primary latch 124 is mounted to the top side 308. The top side 308 of the housing 110 defines a window 310 located axially between the primary latch 124 and the rear end 304. The window 310 extends fully through a top wall 312 of the housing 110 and is open to the cavity 106. The window 310 is configured to receive a protrusion 314 of the contact subassembly 120 therethrough when the protrusion 314 is angularly oriented towards the top wall 312, as described below in more detail. The housing 110 may also include at least one deflectable latch 364 rearward of the primary latch 124. The deflectable latch 364 is configured to extend at least partially into the cavity 106 to engage the protrusion 314 of the contact subassembly 120.

The contact subassembly 120 is configured to be loaded into the cavity 106 of the housing 110 through the opening 306 at the rear end 304. For example, the contact subassembly 120 is moved relative to the housing 110 in a loading direction 316 along the longitudinal axis 193 towards the front end 302 of the housing 110. The contact subassembly 120 includes a contact mating portion 144 that is generally cylindrical. The contact mating portion 144 is configured to engage a complementary contact mating portion of the contact subassembly 118 (shown in FIG. 1) of the male connector 102 (FIG. 1) when mated. Since the contact mating portion 144 is generally cylindrical, the contact mating portion 144 does not require a particular angular orientation relative to the corresponding contact mating portion of the male connector 102. The contact subassembly 120 further includes a termination portion 146 rearward of the contact mating portion 144. The termination portion 146 mechanically and electrically connects to the cable 116. In an embodiment, the cable 116 is lowered from above a top side 320 of the termination portion 146 into a channel 138 of a dielectric holder 134 to terminate the cable 116 using cable insulation displacement (CID) features 158, 160 (shown in FIGS. 4 and 5). In another embodiment, the cable 116 may be terminated to the contact subassembly 120 by one or more crimping operations that may use one or more ferrules.

The contact subassembly 120 includes at least one protrusion 314 extending outward from an outer surface 318 of the contact subassembly 120. In the illustrated embodiment, the protrusion 314 is a tab 314. The outer surface 318 is a lateral side 212 of the termination portion 146. Although not visible in FIG. 2, the contact subassembly 120 may include two tabs 314 that extend from the outer surface 318 along opposite lateral sides 212 of the contact subassembly 120. The contact subassembly 120 may include more or less than two protrusions 314 in other embodiments.

In an embodiment, the cavity 106 of the housing 110 at the rear end 304 includes a central core 324 and at least one outer channel 326. The housing 110 defines two outer channels 326 in the illustrated embodiment. The central core 324 has a cylindrical shape. The outer channels 326 are open to the central core 324 and extend radially outward from the central core 324. The opening 306 at the rear end 304 is sized and shaped to allow the contact subassembly 120 fully into the cavity 106 only if the contact subassembly 120 is in one or more particular angular orientations relative to the housing 110. For example, the contact subassembly 120 is able to be fully loaded into the cavity 106 only if the tabs 314 are aligned with and received in the outer channels 326 of the cavity 106. The diameter of the central core 324 may be too small to accommodate a diameter of the contact subassembly 120 inclusive of the radial length of a tab 314. As shown in FIG. 2, the contact subassembly 120 is angularly oriented such that the visible tab 314 is aligned with a right outer channel 326A. A left outer channel 326B of the cavity 106 aligns with the tab of the contact subassembly 120 that is not visible in FIG. 2.

Figure 3:
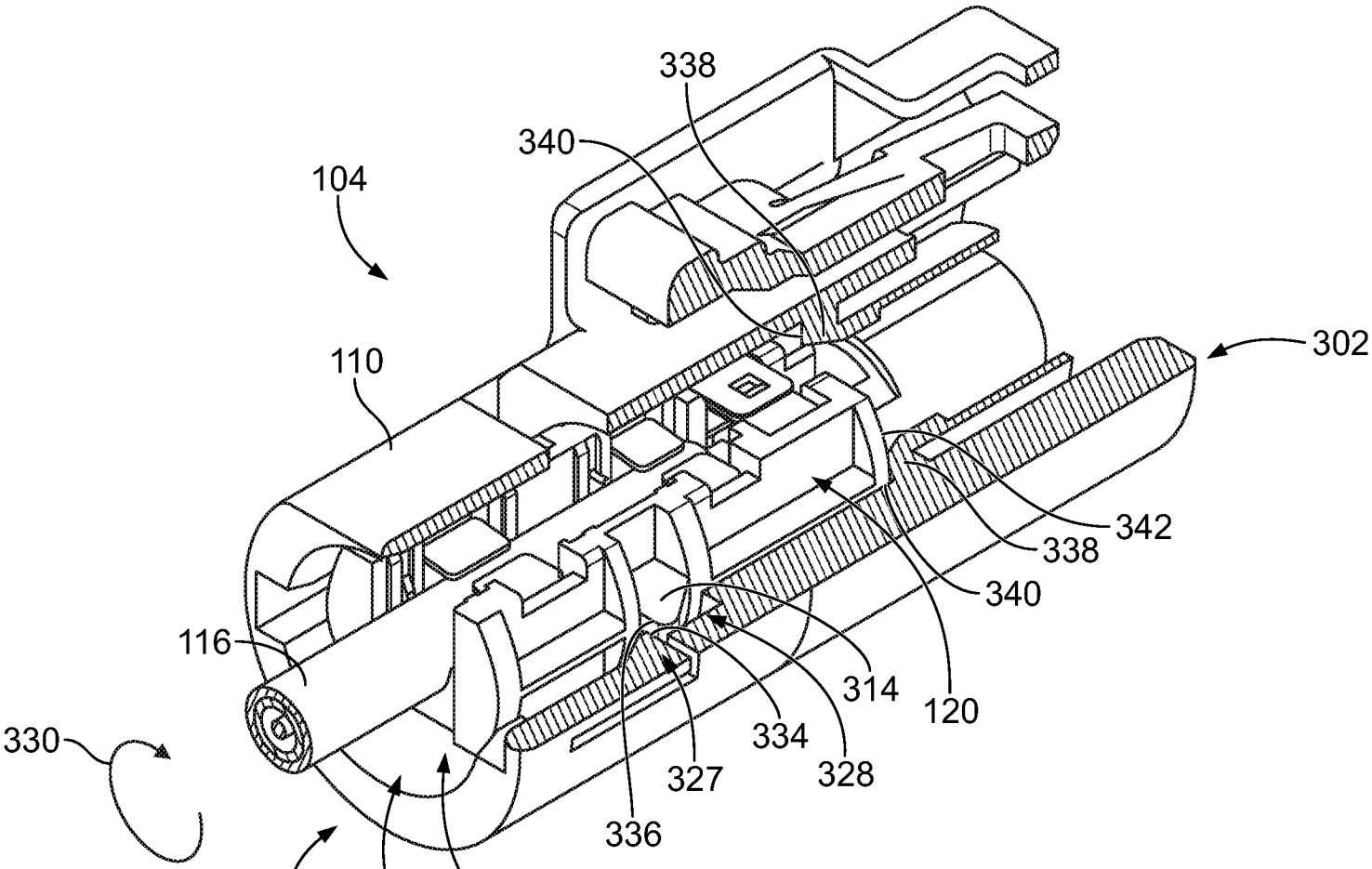
FIG. 3 is a rear perspective view of the electrical connector according to an embodiment showing a quarter portion of a housing of the electrical connector removed.

FIG. 3 is a rear perspective view of the electrical connector 104 according to an embodiment showing a quarter portion of the housing 110 removed. The contact subassembly 120 is in a fully loaded position in the cavity 106 of the housing 110. Since the quarter portion of the housing 110 is removed, the contact subassembly 120 is visible within the cavity 106. The cable 116 extends from the housing 110 through the opening 306 at the rear end 304.

The housing 110 includes a retention mechanism 327 that engages the protrusion 314 (for example, the tab 314) of the contact subassembly 120 to secure an axial position of the contact subassembly 120 in the cavity 106 relative to the housing 110. The retention mechanism 327 is configured to allow the housing 110 to rotate relative to the contact subassembly 120 and the cable 116. For example, the housing 110 may be rotatable in a clockwise direction 330 relative to the contact subassembly 120 and cable 116. The housing 110 may also rotate in an opposite counter-clockwise direction. Since the housing 110 can rotate relative to the cable 116 and contact subassembly 120, the housing 110 can be rotated to properly align with a mating interface of a mating connector without applying tension or other torsional forces on the contact subassembly 120 and/or the cable 116. The retention mechanism 327 of various embodiments described herein does not include a discrete secondary lock or clip that is inserted into the housing 110.

The retention mechanism 327 of the housing 110 includes an annular track 328 that extends along a perimeter of the cavity 106. The annular track 328 is configured to receive the one or more protrusions 314 of the contact subassembly 120 therein. As the housing 110 rotates relative to the contact subassembly 120, the protrusions 314 move (relatively) along a circumferential length of the annular track 328. The housing 110 includes a retention ledge 334 that defines a rear end of the annular track 328. For example, a longitudinal width of the annular track 328 extends frontward from the retention ledge 334 towards the front end 302. The retention ledge 334 is configured to secure an axial position of the contact subassembly 120 by blocking rearward axial movement of the contact subassembly 120 relative to the housing 110. For example, the tab 314 of the contact subassembly 120 includes a catch surface 336 that faces generally rearward towards the rear end 304 of the housing 110. When the tab 314 is disposed in the annular track 328, the catch surface 336 is configured to engage the retention ledge 334 to block rearward axial movement of the contact subassembly 120 relative to the housing 110, retaining the contact subassembly 120 in the fully loaded position shown in FIG. 3. Thus, the retention mechanism 327 is configured to allow the housing 110 to rotate relative to the contact subassembly 120 while prohibiting the contact subassembly 120 from being pulled rearward out of the cavity 106. In one or more embodiments, the retention ledge 334 may be defined by different surfaces of the housing along the circumferential length of the annular track 328, as described below in more detail with reference to FIGS. 6 and 7, instead of a single surface that extends continuously along the full length of the annular track 328.

In the illustrated embodiment, the housing 110 includes an interior shoulder 338 in the cavity 106 that is located axially between the front end 302 and the annular track 328. A rear edge 340 of the interior shoulder 338 engages a front wall 342 of the dielectric holder 134 of the contact subassembly 120 to provide a hard stop surface that blocks additional axial movement of the contact subassembly 120 in the loading direction 316 relative to the housing 110. Thus, the contact subassembly 120 is axially secured in the cavity 106 via engagement with the rear edge 340 of the interior shoulder 338 and the retention ledge 334.

Figure 4:
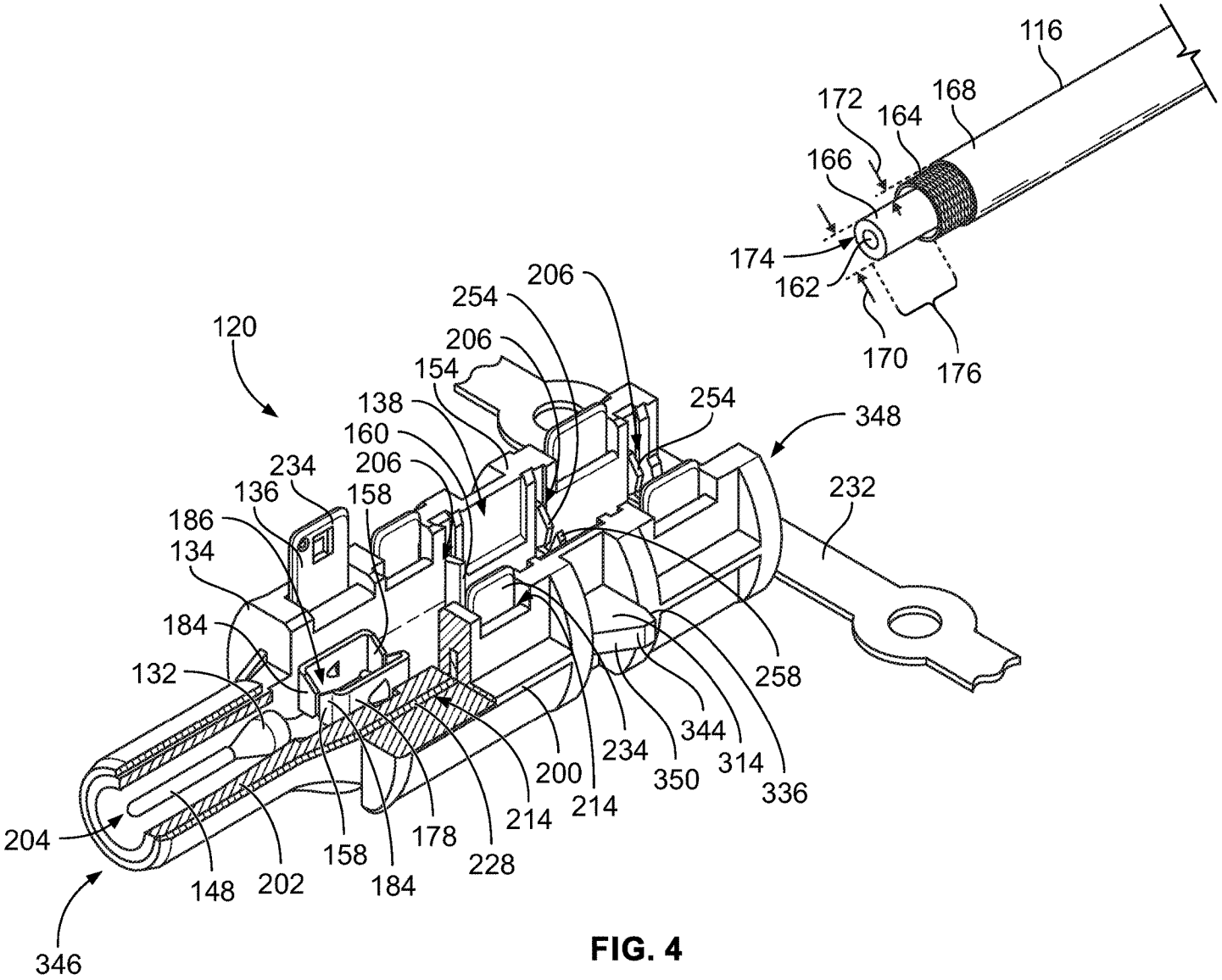
FIG. 4 is a perspective view of a contact subassembly of the electrical connector and an electrical cable according to an embodiment.

FIG. 4 is a perspective view of the contact subassembly 120 and the electrical cable 116 according to an embodiment. The contact subassembly 120 includes the dielectric holder 134, a center contact 132, and an outer contact 136. The contact subassembly 120 is shown in a partial cross-section to allow the center contact 132 and an otherwise-obstructed portion of the outer contact 136 to be visible. The contact subassembly 120 extends between a front end 346 and a rear end 348.

In an embodiment, the cable 116 is a coaxial cable that includes a core conductor 162 having one or more electrical wires composed of a conductive metal material, such as copper, silver, gold, and/or the like. The core conductor 162 is surrounded by an insulation layer 166 that is formed of a dielectric material, such as one or more plastics. The insulation layer 166 protects and electrically insulates the core conductor 162 from a conductive shield layer 164 that surrounds the insulation layer 166. The conductive shield layer 164 provides electrical shielding of the signals transmitted along the core conductor 162, and may also provide an electrical grounding path and/or signal return path. The conductive shield layer 164 may be or include a cable braid that includes woven or braided metal strands. Optionally, the conductive shield layer 164 may include a metallic foil instead of, or in addition to, a cable braid. A jacket 168 of the cable 116 surrounds the shield layer 164. The jacket 168 is formed of a dielectric material, such as one or more plastics. The jacket 168 provides protection against abrasions and contaminants. The jacket 168 also electrically insulates the conductive components 162, 164 of the cable 116 from external electrical interference.

As used herein, the cable 116 is described as having an inner cable portion 170 and an outer cable portion 172 that surrounds the inner cable portion 170. The inner cable portion 170 is composed of the core conductor 162 and the insulation layer 166, and the outer cable portion 172 is composed of the shield layer 164 and the jacket 168. In an embodiment, the cable 116 may be prepared for termination to the contact subassembly 120 by stripping an end 174 of the cable 116. In the illustrated embodiment, the jacket 168 and shield layer 164 are stripped along an end segment 176 of the cable 116 such that the inner cable portion 170 protrudes from the outer cable portion 172 along the end segment 176. Although the shield layer 164 protrudes beyond the jacket 168 and extends more proximate to the end 174 of the cable 116 than the jacket 168 in the illustrated embodiment, the shield layer 164 may be severed at the same location as the jacket 168 in an alternative embodiment.

The dielectric holder 134 defines the channel 138. The channel 138 is open along a top side 154 of the holder 134, such that the dielectric holder 134 resembles a cradle or trough. The dielectric holder 134 is configured to hold the center contact 132 and the outer contact 136. The dielectric holder 134 is composed of a dielectric material, such as one or more plastics, to allow the holder 134 to electrically insulate the center contact 132 from the outer contact 136. The dielectric holder 134 may be formed via a molding process. The dielectric holder 134 also includes a body 200 that defines the channel 138 and a nose segment 202 that extends from the body 200 and defines a cylindrical cavity 204. The body 200 defines multiple apertures 206 extending through the body 200 from a bottom side 156 of the dielectric holder 134 to the channel 138. The body 200 also defines side cavities 214 located on lateral sides of the channel 138. The side cavities 214 extend from the bottom side 156 to the top side 154.

The center contact 132 includes a mating interface 148 and a termination region 178. The mating interface 148 in the illustrated embodiment is a pin, but the mating interface 148 may have other shapes in other embodiments, such as a socket, a blade, or the like. The termination region 178 includes the CID feature 158 that is configured to penetrate one or more layers of the cable 116 to engage the core conductor 162. The CID feature 158 may be referred to as a core-terminating CID feature 158. The CID feature 158 includes two contact walls 184 that define a core slot 186 therebetween. The core slot 186 is open along a top of the center contact 132 to receive the end segment 176 of the cable 116 therein. The contact walls 184 penetrate the insulation layer 166 as the end segment 176 of the cable 116 is pressed into the CID feature 158. The contact walls 184 may be tapered to provide a lead-in area that guides the end segment 176 into the core slot 186. The edges of the contact walls 184 along the lead-in area and along the core slot 186 optionally may be sharpened to slice through the insulation layer 166. In the illustrated embodiment, the termination region 178 of the center contact 132 includes two CID features 158 spaced apart longitudinally from one another. The center contact 132 may be composed of a conductive metal material including copper, silver, aluminum, gold, and/or the like. The center contact 132 may be stamped and formed from an at least partially planar panel into the illustrated shape. The center contact 132 is held by the dielectric holder 134 such that the termination region 178 is held in the channel 138 and the mating interface 148 extends into the cylindrical cavity 204.

The outer contact 136 is composed of a conductive metal material, including one or more of copper, silver, aluminum, gold, or the like. The outer contact 136 in an embodiment is stamped and formed from a planar panel. The outer contact 136 is configured to at least partially surround the dielectric holder 134. The outer contact 136 includes side walls 228 that extend into the side cavities 214 of the dielectric holder 134. The outer contact 136 further includes holding tabs 234 that extend from the side walls 228 and protrude from the side cavities 214 along the top side 154 of the dielectric holder 134. After the cable 116 is received in the channel 138, the holding tabs 234 may be bent or folded to extend at least partially across the channel 138 above the cable 116 to support retention of the cable 116 in the channel 138. The outer contact 136 includes the second CID feature 160, which is referred to herein as a shield-terminating CID feature 160. The shield-terminating CID feature 160 extending through one of the apertures 206 into the channel 138. The CID feature 160 is configured to penetrate one or more layers of the cable 116 to engage the shield layer 164 in order to electrically connect the outer contact 136 to the shield layer 164.

Figure 5:
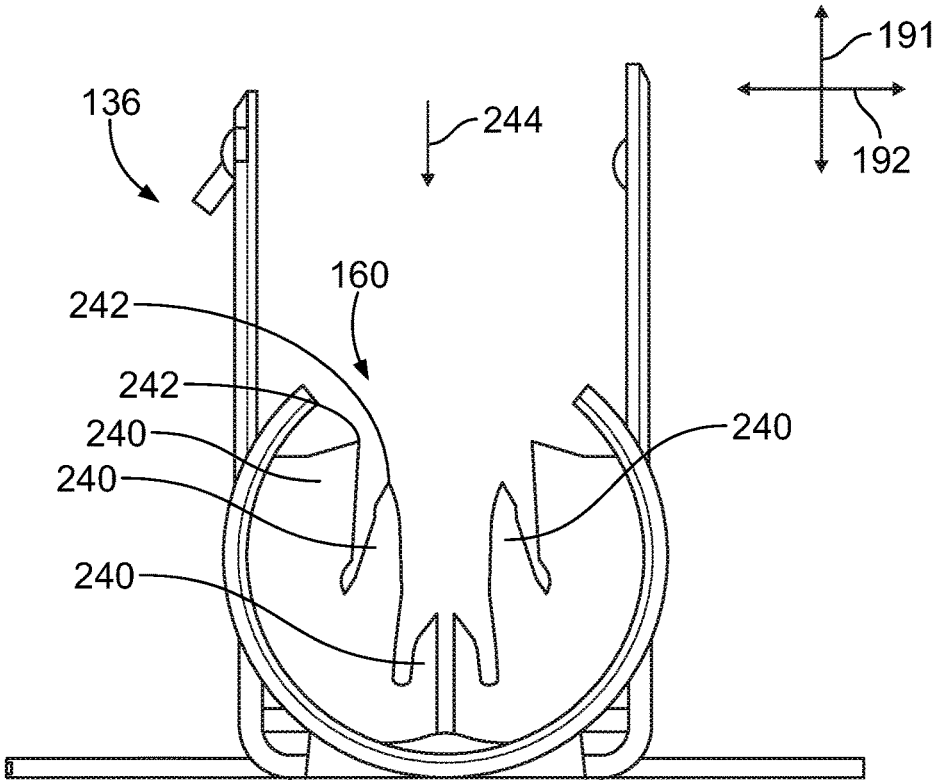
FIG. 5 shows a front view of an outer contact of the contact subassembly according to an embodiment.

Additional reference is made to FIG. 5, which shows a front view of the outer contact 136 according to an embodiment. The shield-terminating CID feature 160 includes multiple blades 240 having pointed tips 242 that are configured to penetrate at least the jacket 168 of the cable 116 to engage and electrically connect to the shield layer 164. The blades 240 are oriented generally vertically to allow the pointed tips 242 to dig into the cable 116 as the cable 116 is loaded in a downward pressing direction 244 relative to the outer contact 136. The blades 240 may penetrate at least partially through the shield layer 164 and may also extend into the insulation layer 166 of the cable 116 in order to ensure that a reliable mechanical and electrical connection is established with the shield layer 164. The blades 240 do not penetrate the insulation layer 166 far enough to engage the core conductor 162.

Referring now only to FIG. 4, the outer contact 136 may include at least one strain relief CID feature 254 configured to provide strain relief. The outer contact 136 in the illustrated embodiment includes two strain relief CID features 254 located rearward of the shield-terminating CID feature 160. The strain relief CID features 254 extend into the channel 138 through corresponding apertures 206. The strain relief CID features 254 may be similar to the shield-terminating CID feature 160 in shape and function. For example, the strain relief CID features 254 each include at least one blade 258. The blades 258 may be configured to penetrate the jacket 168, the shield layer 164, and at least partially into the insulation layer 166 in order to provide mechanical retention and strain relief. The outer contact 136 may have other numbers of shield-terminating CID features 160 and strain relief CID features 254 in alternative embodiments. Optionally, the outer contact 136 is attached to a carrier strip 232 at the rear end 348 of the contact subassembly 120. Thus, the contact subassembly 120 may be assembled on a carrier strip 232 with other contact subassemblies 120.

As shown in FIG. 4, the core-terminating CID features 158, the shield-terminating CID feature 160, and the strain relief CID features 254 are all disposed in the channel 138. The contact subassembly 120 according to one or more embodiments provides a one-step press termination of the cable 116 to the contact subassembly 120. For example, the cable 116 may be pressed into the channel 138 manually or via an automated machine, such as a press device, from above the contact subassembly 120. As the cable 116 is pressed into the channel 138, the core-terminating CID features 158 of the center contact 132 engage the inner cable portion 170 along the end segment 176 to penetrate the insulation layer 166 and engage the core conductor 162. The shield-terminating CID feature 160 and the strain relief CID features 254 of the outer contact 136 engage the outer cable portion 172 and penetrate the jacket 168 to engage the shield layer 164. Therefore, the contact subassembly 120 allows the cable 116 to terminate to both the center contact 132 and the outer contact 136 by a single press of the cable 116 into the channel 138.

The protrusion 314 of the contact subassembly 120 in the illustrated embodiment is a tab 314 that extends laterally outward from the lateral side 212 of the contact subassembly 120. The tab 314 in the illustrated embodiment is integral to the dielectric holder 134. In an alternative embodiment, the protrusion 314 may be a component of the outer contact 136 instead of the dielectric holder 134. The tab 314 includes a ramp surface 344 and the catch surface 336. The catch surface 336 faces rearward towards the rear end 348. The ramp surface 344 extends from a front 350 of the tab 314 to the catch surface 336. The ramp surface 344 is angled such that the tab 314 extends farther from the lateral side 212 with distance along the ramp surface 344 from the front 350 towards the catch surface 336.

Figure 7:
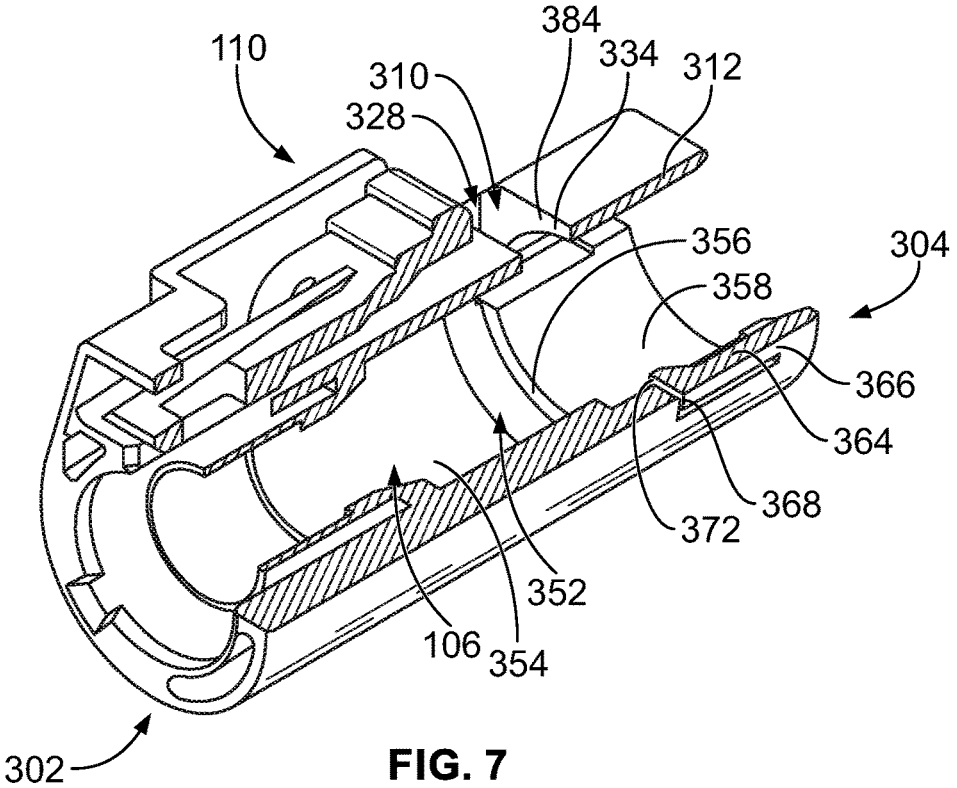
FIG. 7 is a second cross-sectional perspective front view of the housing of the electrical connector.
Figure 6:
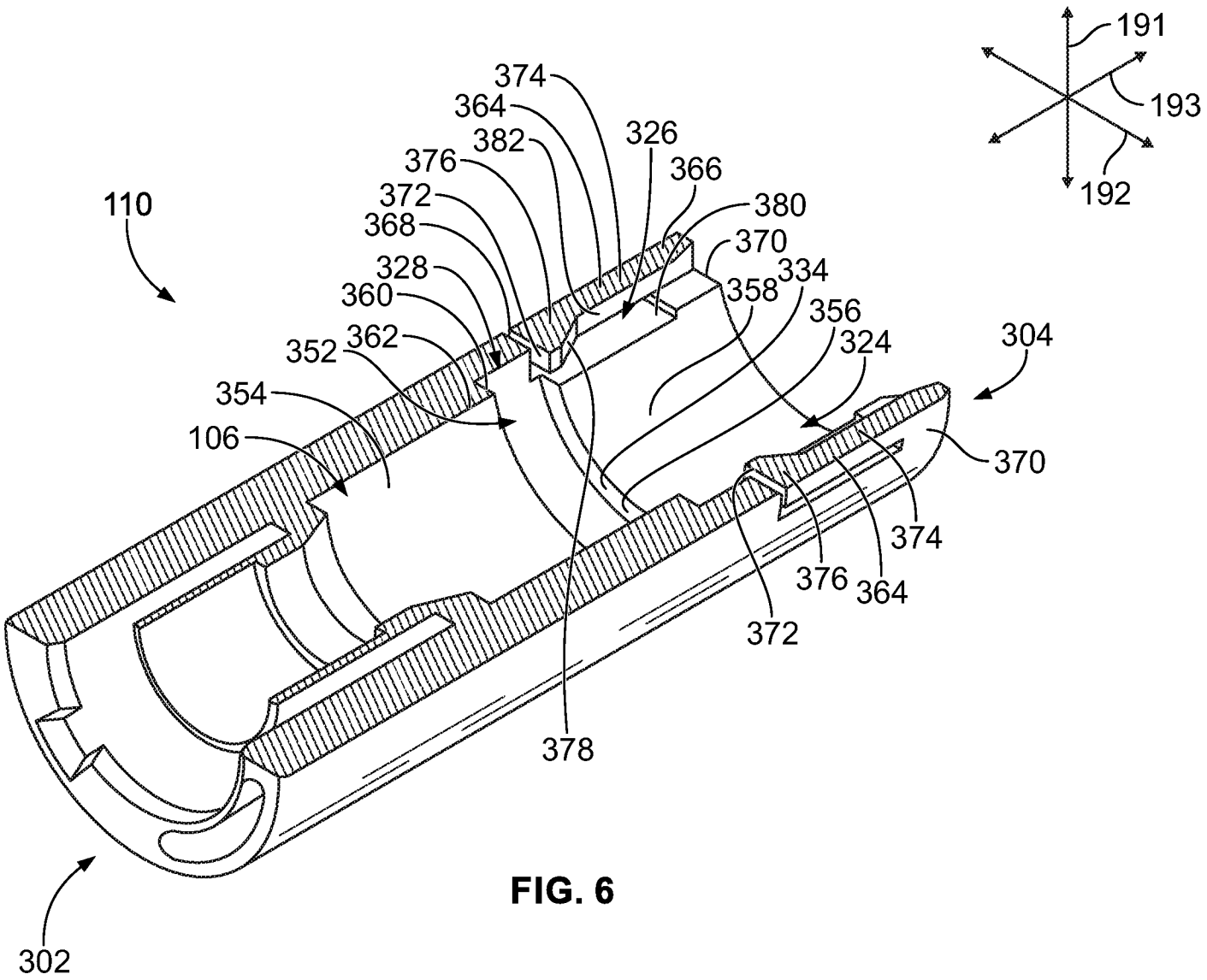
FIG. 6 is a first cross-sectional perspective front view of the housing of the electrical connector according to an embodiment.

FIG. 6 is a first cross-sectional perspective front view of the housing 110 of the electrical connector 104 (shown in FIG. 1) according to an embodiment. FIG. 7 is a second cross-sectional perspective front view of the housing 110 of the electrical connector 104. The view in FIG. 6 shows approximately half of the housing 110, and the view in FIG. 7 shows approximately three-quarters of the housing 110. In the illustrated embodiment, the housing 110 includes a groove-shaped recess 352 defined along an inner surface 354 of the housing 110 that defines the cavity 106. The groove-shaped recess 352 defines at least a circumferential segment of the annular track 328. The retention ledge 334 of the annular track 328 along the recess 352 (for example, the rear end of the recess 352) is defined by a front edge 356 of a first interior shoulder 358 of the housing 110. The first interior shoulder 358 is a fixed structure of the housing 110. The interior shoulder 358 may extend longitudinally from the recess 352 to the rear end 304 of the housing 110. A rear edge 360 of a second interior shoulder 362 defines a front end of the recess 352. The longitudinal width of the recess 352 between the rear edge 360 and the front edge 356 accommodates the at least one protrusion 314 (shown in FIG. 3) of the contact subassembly 120 (FIG. 3).

In an embodiment, the housing 110 includes at least one deflectable latch 364 extending from a fixed end 366 and a free end 368. The fixed end 366 is secured to a wall 370 of the housing 110 at an axial location between the annular track 328 and the rear end 304. The free end 368 is not directly secured to the wall 370 and is able to move relative to the wall 370 about the fixed end 366. The fixed end 366 is located rearward of the free end 368. Optionally, the latch 364 may be oriented to extend along the longitudinal axis 193. The housing 110 in the illustrated embodiment includes two latches 364, but may include more or less than two latches 364 in other embodiments. The latches 364 are deflectable between an unbiased or resting position and a deflected position. In the unbiased position, the latch 364 is configured to extend at least partially into the cavity 106 in a loading path of the contact subassembly 120 (shown in FIG. 3). In the deflected position, the protrusion 314 (FIG. 3) of the contact subassembly 120 engages and deflects the latch 364 radially outward out of the path of the contact subassembly 120 to allow the protrusion 314 to enter the annular track 328. The latch 364 has a catch surface 372 at least proximate to the free end 368 that faces generally towards the front end 302 of the housing 110. In the illustrated embodiment, the catch surface 372 is located at the free end 368.

In an embodiment, when the latch 364 is in the un-biased position, as shown in FIG. 6, the catch surface 372 defines a segment of the retention ledge 334 of the annular track 328. For example, the catch surface 372 of a latch 364 extends adjacent to the front edge 356 of the first interior shoulder 358. The front edge 356 of the interior shoulder 358 defines a first circumferential segment of the retention ledge 334, and the catch surface 372 of a corresponding latch 364 defines a second circumferential segment of the retention ledge 334. As shown in FIG. 6, the catch surfaces 372 of the two latches 364 border the front edge 356 of the interior shoulder 358 along a perimeter of the cavity 106, and each define respective circumferential segments of the retention ledge 334. The latches 364 optionally each include an arm 374 and a head 376. The arm 374 extends from the fixed end 366 to the head 376, and the head 376 extends to the free end 368. The head 376 includes a ramp surface 378 that extends radially inward into the cavity 106 gradually with increasing distance along the head 376 towards the free end 368. The ramp surface 378 extends to the catch surface 372.

As shown in FIG. 7, the window 310 of the housing 110 that is defined through the top wall 312 may define an upper segment of the annular track 328. For example, the window 310 aligns circumferentially with the groove-shaped recess 352. The upper segment of the annular track 328 may be defined by a window 310 in the housing 110 instead of another groove-shaped recess because the top wall 312 is at least partially planar instead of cylindrical. The retention ledge 334 along the upper segment of the annular track 328 is defined by an edge 384 of the top wall 312 that defines a rear end of the window 310.

In an embodiment, the annular track 328 extends around full perimeter of the cavity 106. The retention ledge 334 along the entire circumferential length of the annular track 328 is defined by various components of the housing 110, including the front edge 356 of the interior shoulder 358, the catch surfaces 372 of the latches 364, and the edge 384 of the top wall 312.

As shown in FIG. 6, the outer channels 326 of the cavity 106 extend longitudinally from the rear end 304 to the annular track 328. The outer channels 326 are at least partially defined by perimeter edges 380 of the first interior shoulder 358. In an embodiment, the deflectable latches 364 extend into the outer channels 326 when in the unbiased position to engage the protrusion 314 of the contact subassembly 120 that is received therein. For example, interior sides 382 of the latches 364 define an outer wall of the outer channels 326. The deflectable latches 364 do not extend into the central core 324 of the cavity 106.

Figure 8:
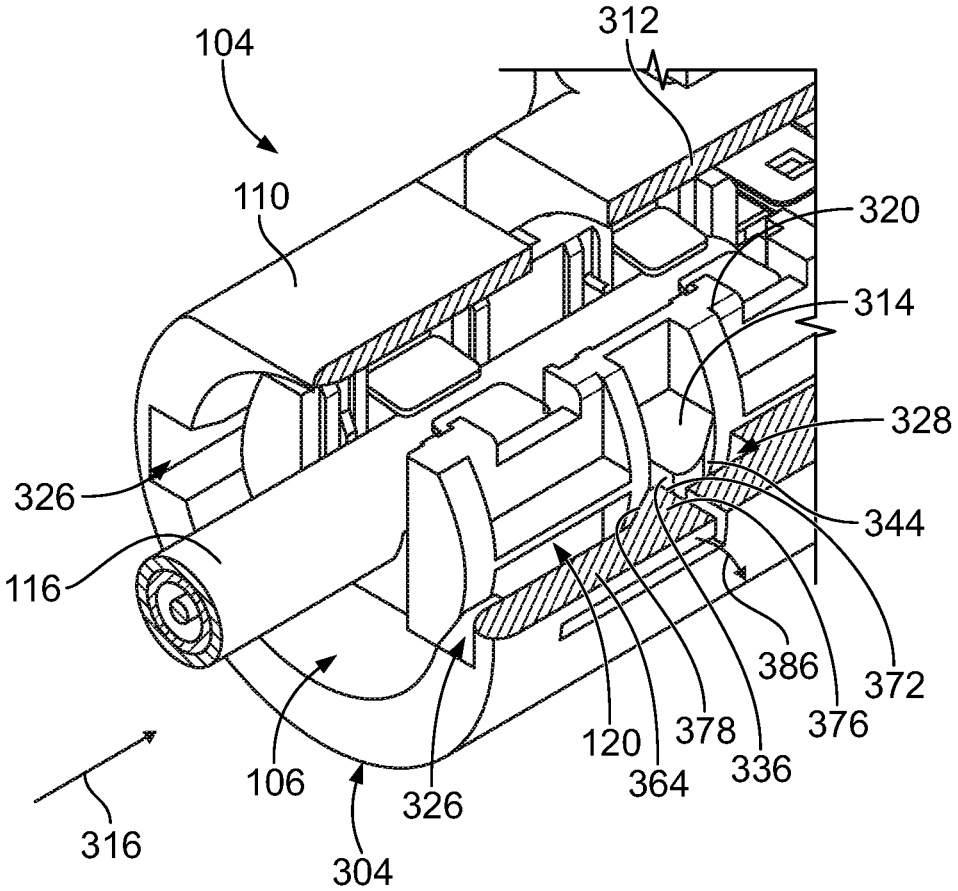
FIG. 8 is a rear perspective view of a portion of the electrical connector according to an embodiment shown in FIG. 3 in which the contact subassembly is in a first angular orientation relative to the housing.

FIG. 8 is a rear perspective view of a portion of the electrical connector 104 according to an embodiment shown in FIG. 3. In an embodiment, as the contact subassembly 120 is loaded into the cavity 106 through the rear end 304, the tabs 314 are received in the corresponding outer channels 326. Only one of the two tabs 314 is shown in FIG. 8. Movement of the contact subassembly 120 in the loading direction 316 causes the ramp surface 344 of the tab 314 to engage the complementary ramp surface 378 of the deflectable latch 364 within the outer channel 326. The tab 314 gradually deflects the latch 364 radially outward in a deflection arc 386 as the tab 314 moves translationally in the loading direction 316 relative to the housing 110. The deflection of the latch 364 causes the head 376 of the latch 364 to move out of the path of the tab 314, allowing the tab 314 to enter the annular track 328. Once the catch surface 336 of the tab 314 passes the catch surface 372 of the latch 364, the deflectable latch 364 is allowed to resiliently return radially inwards towards the unbiased position. In the unbiased position, the catch surface 372 is received behind the catch surface 336 of the tab 314 such that rearward movement of the contact subassembly 120 relative to the housing 110 would cause the catch surfaces 336, 372 to engage one another, blocking additional rearward movement of the contact subassembly 120.

The illustrated embodiment shows the contact subassembly 120 in a first angular orientation relative to the housing 110. The contact subassembly 120 is loaded into the housing 110 in the first angular orientation to allow the tabs 314 to be received in the outer channels 326. Once the contact subassembly 120 is fully loaded in the housing 110 such that the tabs 314 are located within the annular track 328, the housing 110 is able to rotate relative to the contact subassembly 120 and the cable 116. In an embodiment, the housing 110 is able to rotate 360 degrees.

Figure 9:
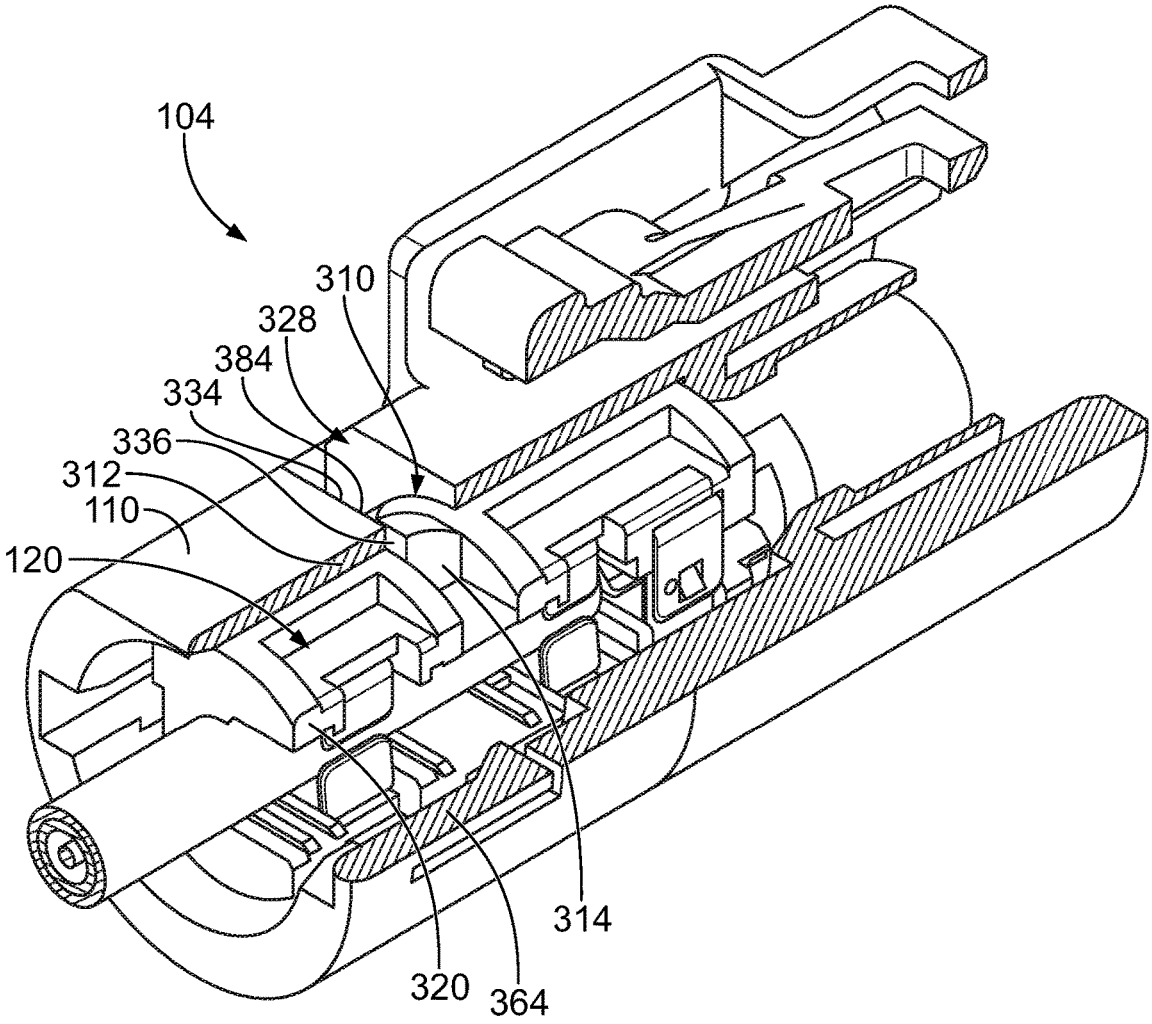
FIG. 9 shows a rear perspective view of the electrical connector in which the contact subassembly is in a second angular orientation relative to the housing.

FIG. 9 shows a rear perspective view of the electrical connector 104 in which the contact subassembly 120 is in a second angular orientation relative to the housing 110. In the second angular orientation, the top 320 of the contact subassembly 120 faces towards one of the deflectable latches 364 along a lateral side of the housing 110, as compared to the first angular orientation shown in FIG. 8 in which the top 320 of the contact subassembly 120 faces the top wall 312. In addition, one of the tabs 314 of the contact subassembly 120 in the second angular orientation is angularly oriented towards the top wall 312 of the housing 110 and extends at least partially through the window 310. As shown in FIG. 9, a rearward force of the contact subassembly 120 relative to the housing 110 would cause the catch surface 336 of the tab 314 to abut against the edge 384 of the top wall 312 that defines the retention ledge 334 along the top segment of the annular track 328 to retain the contact subassembly 120 in the loaded position within the housing 110.

Figure 10:
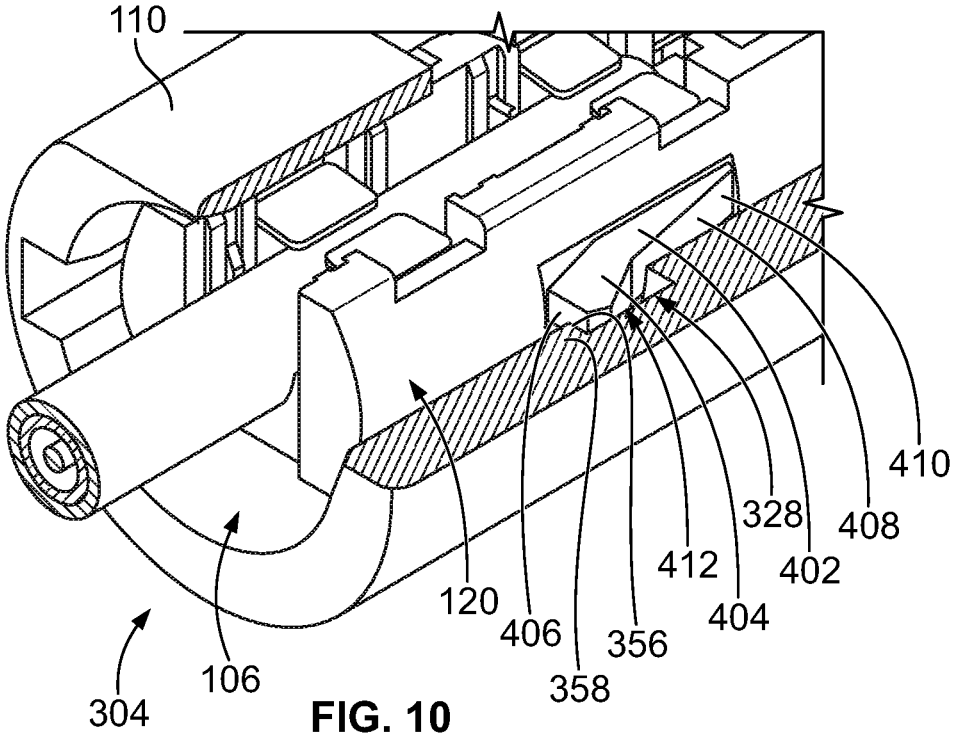
FIG. 10 is a rear perspective view of a portion of the electrical connector according to an alternative embodiment.

FIG. 10 is a rear perspective view of a portion of the electrical connector 104 according to an alternative embodiment. In FIG. 10, the protrusion of the electrical connector 104 is a deflectable latch 402 instead of a tab. The latch 402 is oriented such that a head 404 of the latch 402 that defines a catch surface 406 is located rearward of an arm 408 of the latch 402 that extends to a fixed end 410. As the contact subassembly 120 is loaded into the cavity 106 of the housing 110 from the rear end 304, the head 404 of the latch 402 engages the interior shoulder 358 that extends between the rear end 304 and the annular track 328. The interior shoulder 358 deflects the latch 402 radially inward until the catch surface 406 of the latch 402 extends beyond the front edge 356 of the shoulder 358, at which point the latch 402 resiliently moves radially outward towards an unbiased position. In the unbiased position as shown in FIG. 10, the head 404 of the latch 402 is disposed in the annular track 328. The catch surface 406 is configured to engage the front edge 356 of the shoulder 358 to retain the axial position of the contact subassembly 120 in the housing 110. At least a circumferential segment of the annular track 328 shown in FIG. 10 may be defined by a groove-shaped recess 412.

In another alternative embodiment, the at least one protrusion of the contact subassembly 120 may be an annular ring or flange that extends outward from the outer surface of the contact subassembly 120 along at least an extended length of the perimeter of the contact subassembly 120, instead of one or more tabs that do not have extended lengths along the perimeter. Furthermore, the retention ledge of the annular track of the housing 110 may be defined entirely by catch surfaces of one or more deflectable latches of the housing 110 that extend into the cavity 106. Thus, as the contact subassembly 120 is loaded into the housing 110, the annular ring engages and deflects the one or more latches radially outward until a rear catch surface of the annular ring is located in front of the catch surfaces of the latches, and the latches are allowed to resiliently move radially inward behind the annular ring to secure the axial location of the contact subassembly 120 relative to the housing 110. In all embodiments described herein, the housing 110 is able to rotate relative to the contact subassembly 120, and the housing 110 secures an axial position of the contact subassembly 120.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical cable connector comprising:

a contact subassembly terminated to an electrical cable, the contact subassembly including a center contact, a dielectric holder, and an outer contact, the contact subassembly having a protrusion extending outward from an outer surface of the contact subassembly; and a housing extending between a front end and a rear end, the housing defining a cavity that receives the contact subassembly therein, the electrical cable extending from the housing through an opening at the rear end, the housing including a retention mechanism that includes an annular track along a perimeter of the cavity, the annular track receiving the protrusion of the contact subassembly therein, wherein a retention ledge of the housing at a rear end of the annular track engages the protrusion of the contact subassembly to secure an axial position of the contact subassembly in the cavity relative to the housing, the retention mechanism allowing the housing to rotate relative to the contact subassembly and the cable such that the protrusion moves within the annular track, wherein a first circumferential segment of the retention ledge is defined by an interior shoulder of the housing and a second circumferential segment of the retention ledge is defined by a catch surface of a deflectable latch on the housing, the protrusion engaging and deflecting the deflectable latch radially outward as the contact subassembly is loaded into the cavity to allow the protrusion to enter the annular track.

2. The electrical cable connector of claim 1, wherein the protrusion is a tab of the dielectric holder that has a catch surface generally facing the rear end of the housing, the catch surface engaging the retention ledge of the housing to block rearward axial movement of the contact subassembly relative to the housing.

3. The electrical cable connector of claim 1, wherein the annular track of the housing extends along a full perimeter of the cavity and the housing is rotatable 360 degrees relative to the contact subassembly and the cable.

4. The electrical cable connector of claim 1, wherein the housing has a top wall that includes a window extending therethrough, the window defining an upper segment of the annular track such that the protrusion at least partially extends through the window when the protrusion is angularly oriented towards the top wall, the retention ledge of the annular track along the upper segment being defined by an edge of the top wall along a rear end of the window.

5. The electrical cable connector of claim 1, wherein the housing includes a groove-shaped recess along an inner surface of the housing, the groove-shaped recess defining at least a circumferential segment of the annular track, the retention ledge of the annular track along the groove-shaped recess being defined by a front edge of an interior shoulder of the housing.

6. The electrical cable connector of claim 1, wherein the deflectable latch has a fixed end located axially between the annular track and the rear end of the housing.

7. The electrical cable connector of claim 1, wherein the cavity of the housing includes a central core and an outer channel, the outer channel open to the central core and extending radially outward therefrom, the outer channel extending longitudinally between the annular track and the rear end, the opening of the cavity at the rear end being sized to allow the contact subassembly in the cavity only if the protrusion is received in the outer channel, the deflectable latch extending into the outer channel to engage the protrusion therein.

8. The electrical cable connector of claim 1, wherein the dielectric holder defines a channel that is open along a top side of the dielectric holder, the center contact including a first cable insulation displacement (CID) feature held in the channel, the outer contact at least partially surrounding the dielectric holder, the outer contact including a second CID feature that extends into the channel through an aperture in the dielectric holder, the electrical cable held in the channel such that the first CID feature penetrates the cable to engage a core conductor of the cable and the second CID feature penetrates the cable to engage a shield layer of the cable.

9. An electrical cable connector comprising:

a contact subassembly terminated to an electrical cable, the contact subassembly including a center contact, a dielectric holder, and an outer contact, the contact subassembly including a deflectable latch extending outward from an outer surface of the contact subassembly, the deflectable latch having a head that includes a catch surface, and;

a housing extending between a front end and a rear end, the housing defining a cavity that receives the contact subassembly therein, the electrical cable extending from the housing through an opening at the rear end, the housing including an annular track that receives the head of the deflectable latch therein, a rear end of the annular track being at least partially defined by a front edge of an interior shoulder of the housing, the deflectable latch of the contact subassembly engaging the interior shoulder and deflecting radially inward as the contact subassembly is received in the cavity through the rear end, the deflectable latch resiliently moving radially outward towards an unbiased position when the catch surface is in front of the interior shoulder to allow the catch surface to engage the front edge.

10. The electrical cable connector of claim 9, wherein the annular track of the housing extends along a full perimeter of the cavity and the housing is rotatable 360 degrees relative to the contact subassembly and the cable.

11. The electrical cable connector of claim 9, wherein the cavity of the housing includes a central core and an outer channel, the outer channel open to the central core and extending radially outward therefrom, the outer channel extending longitudinally between the annular track and the rear end, the opening of the cavity at the rear end being sized to allow the contact subassembly in the cavity only if the deflectable latch is received in the outer channel.

12. An electrical cable connector comprising:

a contact subassembly terminated to an electrical cable, the contact subassembly including a center contact, a dielectric holder, and an outer contact, the contact subassembly having a protrusion extending outward from an outer surface of the contact subassembly; and a housing extending between a front end and a rear end, the housing defining a cavity that receives the contact subassembly therein, the electrical cable extending from the housing through an opening at the rear end, the housing including an annular track along a perimeter of the cavity that receives the protrusion of the contact subassembly therein, the protrusion configured to move along a circumferential length of the annular track as the housing is rotated relative to the contact subassembly and the electrical cable, the housing including a retention ledge that defines a rear end of the annular track, the retention ledge engaging a catch surface of the protrusion to block rearward axial movement of the contact subassembly relative to the housing.

13. The electrical cable connector of claim 12, wherein the housing includes a deflectable latch extending from a fixed end and a free end, the fixed end secured to a wall of the housing axially between the annular track and the rear end of the housing, a catch surface of the deflectable latch at least proximate to the free end defining a segment of the retention ledge of the annular track when the deflectable latch is in an unbiased position, the protrusion of the contact subassembly engaging and deflecting the deflectable latch radially outward as the contact subassembly is loaded into the cavity to allow the protrusion to enter the annular track.

14. The electrical cable connector of claim 13, wherein the protrusion is a tab of the dielectric holder that has a ramp surface and a catch surface, the catch surface facing rearward and disposed rearward of the ramp surface, the ramp surface engaging a complementary ramp surface of the deflectable latch of the housing within the outer channel to gradually deflect the deflectable latch radially outward as the contact subassembly is loaded into the cavity through the rear end of the housing, the catch surface of the protrusion engaging the retention ledge of the housing when the protrusion is received in the annular track.

15. The electrical cable connector of claim 13, wherein the cavity of the housing includes a central core and an outer channel, the outer channel open to the central core and extending radially outward therefrom, the outer channel extending longitudinally between the annular track and the rear end, the opening of the cavity at the rear end being sized to allow the contact subassembly in the cavity only if the protrusion is received in the outer channel, the deflectable latch extending into the outer channel to engage the protrusion therein.

16. The electrical cable connector of claim 15, wherein the protrusion of the contact subassembly, the deflectable latch of the housing, and the outer channel of the housing are a first protrusion, a first deflectable latch, and a first outer channel, the contact subassembly further including a second protrusion spaced apart angularly from the first protrusion, the second protrusion received in a second outer channel of the housing, the second protrusion within the second outer channel engaging and deflecting a second deflectable latch to allow the second protrusion to enter the annular track.

17. The electrical cable connector of claim 12, wherein the housing includes keying features at the front end that require a specific angular orientation of the housing relative to a housing of a mating connector, the contact subassembly including a contact mating portion that is generally cylindrical and does not require a specific angular orientation relative to a corresponding contact mating portion of the mating connector.

18. The electrical cable connector of claim 12, wherein the housing includes a groove-shaped recess along an inner surface of the housing, the groove-shaped recess defining at least a circumferential segment of the annular track, the retention ledge of the annular track along the groove-shaped recess being defined by a front edge of an interior shoulder of the housing.

19. The electrical cable connector of claim 12, wherein a first circumferential segment of the retention ledge is defined by an interior shoulder of the housing and a second circumferential segment of the retention ledge is defined by a catch surface of a deflectable latch on the housing, the protrusion of the contact subassembly engaging and deflecting the deflectable latch radially outward as the contact subassembly is loaded into the cavity to allow the protrusion to enter the annular track.

20. The electrical cable connector of claim 12, wherein the dielectric holder defines a channel that is open along a top side of the dielectric holder, the center contact including a first cable insulation displacement (CID) feature held in the channel, the outer contact at least partially surrounding the dielectric holder, the outer contact including a second CID feature that extends into the channel through an aperture in the dielectric holder, the electrical cable held in the channel such that the first CID feature penetrates the cable to engage a core conductor of the cable and the second CID feature penetrates the cable to engage a shield layer of the cable.

* * * * *